United States Patent [19]

Crosby et al.

[11] 4,055,865

[45] Nov. 1, 1977

[54] SPRING ATTACHMENT ASSEMBLIES

[75] Inventors: Lawton H. Crosby, Lake Bluff, Ill.; Thomas H. Keane, Morristown, Tenn.

[73] Assignee: Morley Furniture Spring Corporation, Chicago, Ill.

[21] Appl. No.: 696,544

[22] Filed: June 16, 1976

Related U.S. Application Data

[63] Continuation-in-part of Ser. No. 501,155, Aug. 28, 1974, Pat. No. 3,971,082.

[51] Int. Cl.[2] ..... A61J 19/00; F16F 1/46

[52] U.S. Cl. ..... 5/259 R; 5/260; 267/107; 267/112

[58] Field of Search ..... 5/259, 260; 267/110, 267/112, 103, 107

[56] References Cited

U.S. PATENT DOCUMENTS

| | | | |
|---|---|---|---|
| 2,007,385 | 7/1935 | Stackhouse | 267/112 |
| 2,293,566 | 8/1942 | Shanahan | 267/110 |
| 2,440,001 | 4/1948 | Blumensaadt | 267/107 |
| 2,877,471 | 3/1959 | Anstett | 5/259 |
| 3,276,801 | 10/1966 | Jones | 267/110 |
| 3,308,486 | 3/1967 | Jones | 5/259 |
| 3,386,725 | 6/1968 | Fujikawa | 267/110 |
| 3,628,780 | 12/1971 | Saito | 267/110 |
| 3,667,749 | 6/1972 | Platt et al. | 267/112 |
| 3,790,149 | 2/1974 | Crosby | 267/110 |

FOREIGN PATENT DOCUMENTS

| | | | |
|---|---|---|---|
| 530,621 | 1956 | Canada | 5/260 |

*Primary Examiner*—Paul R. Gilliam
*Assistant Examiner*—Victor N. Sarran
*Attorney, Agent, or Firm*—Richard G. Lione

[57] ABSTRACT

A rail attachment assembly for attaching an end of a sinuous spring band to a steel rail. A vertical flange of the rail is provided with pairs of longitudinally spaced apertures to facilitate passage of anchor links or band elements. The steel rail section between the apertures in each pair is deformed inwardly of the flange to permit seating of the heavier gauge band segment or the lighter gauge link segment for rotation about a fixed axis. Where either a link or a spring is employed, noise, grinding and squeeking normally associated with uncontrolled vertical and/or lateral motion and travel of the link or springs; i.e., "wandering", is obviated.

4 Claims, 7 Drawing Figures

FIG. 1
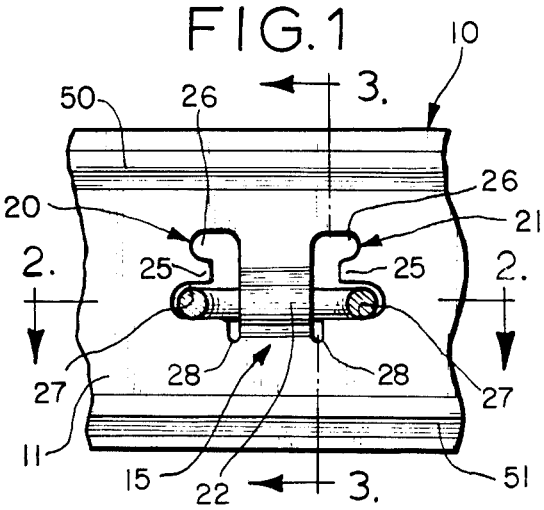
FIG. 3
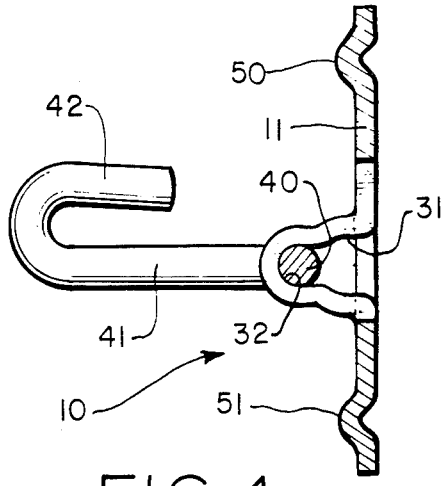
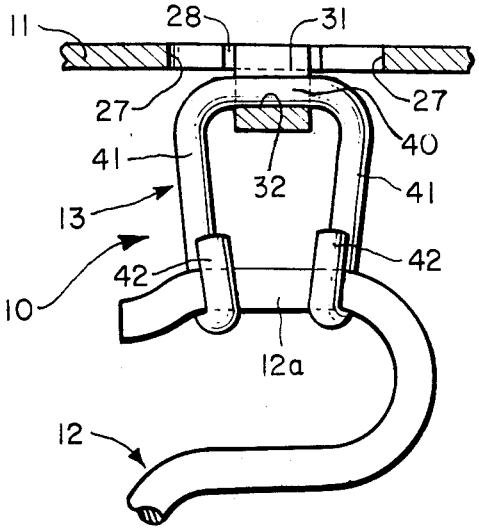
FIG. 2
FIG. 4
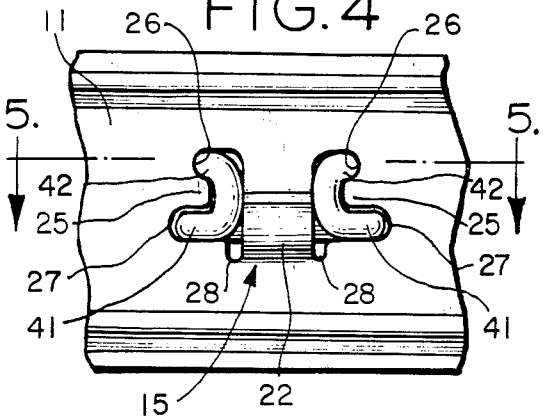
FIG. 5
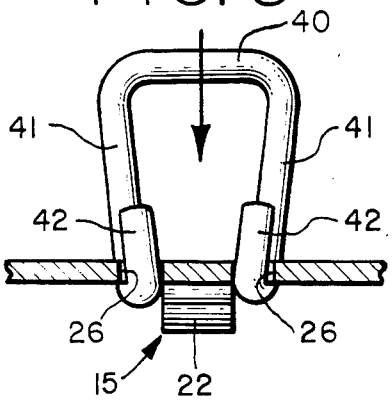
FIG. 6
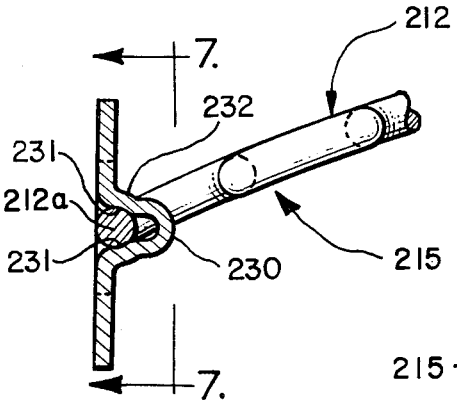
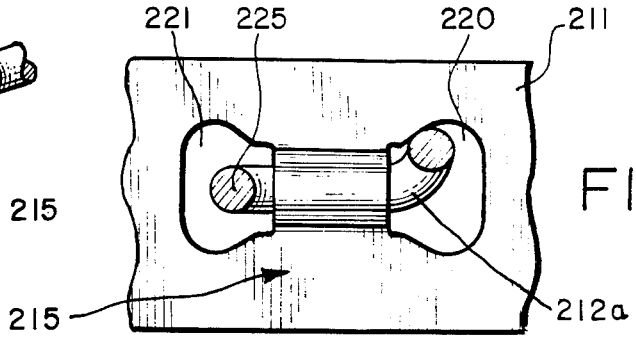
FIG. 7

SPRING ATTACHMENT ASSEMBLIES

RELATED APPLICATIONS

This application is a continuation-in-part of co-pending application Ser. No. 501,155, filed Aug. 28, 1974.

FIELD OF THE INVENTION

This invention is in the field of furniture springs or the like. It relates particularly to attachment hardware and assemblies for attaching sinuous springs to steel rails in a furniture frame or the like.

BACKGROUND OF THE INVENTION

Sinuous springs have been widely used in seat spring assemblies for a long time. They were originally developed to provide a spring seat which was substantially less expensive than traditional coil springs but provided satisfactory comfort. Nevertheless, until recently, no one has disputed the fact that coil springs did provide a much more luxurious seat.

In the last ten years, or so, developments of Lawton H. Crosby have greatly improved the results obtained with sinuous springs. As a result of these developments and others, many more sinuous spring seat assemblies are being used.

Conventionally, sinuous seat spring assemblies comprise wood rail frames with a plurality of sinuous spring bands stretched between them. An alternative is the steel rail construction wherein steel channels, angle irons or plain bars replace the wooden rails. The present invention is concerned with rail attachment assemblies and rail constructions for attaching sinuous spring bands to steel rails.

Steel rails are presently used primarily in heavyduty industrial, aviation, automotive, institutional and theater seating arrangements where the need for luxury, comfort, or noiselessness in minimal. In these cases, it is sufficient to merely attach the ends of the sinuous spring bands directly to the rails.

In residential furniture, however, a much higher level of luxury is desirable, if not required, and there must be no noise whatever. In other words, softness and resiliency are vital, not only at the center of the spring bands but also at the front and back rails.

The use of links providing radial, articulated action between the spring band ends and the front and back rails is the best way to get softness, resiliency and what is known in the trade as "deep-drop", a luxurious sinking in to the seat while still having substantial support. However, the conventional provision of apertures in the steel rails by punching, or forming of certain portions of the rail to form hooks, does not permit the use of radial action links or spring-ends into such apertures in residential furniture because such attachment means could not and does not hold the base segment of the link or spring against uncontrolled vertical and lateral motion as the spring band flexes and the link or spring-end moves up and down. Such uncontrolled motion causes unacceptable grinding and squeeking noises. This uncontrolled vertical or lateral motion and travel of the link or spring-end is referred to herein as "wandering".

In addition, where the rails are apertured, the apertures required must be relatively large to receive the spring ends. If relatively large apertures are punched for each of the large number of springs utilized in a normal sized sofa, for example, a dangerous weakening of the rail can result. Such is not the case in commercial seating, of course, where the number and span-lengths of springs are greatly reduced and the depth of deflection substantially less.

SUMMARY OF THE INVENTION

An object of the present invention is to provide imporved rail attachment assemblies for attaching sinuous spring bands to steel frame rails. Another object is to provide an attachment assembly which permits attachment links to rotate in radial action but prevents either vertical or lateral slippage, sliding or travel; i.e., "wandering", either of the link or of the spring.

In the present invention the steel rail is punched and formed to provide pairs of longitudinally spaced apertures and seating depressions producing new and unexpected, highly advantageous results. The shape of the apertures and the seating depressions permit the links or springs to rotate in radial action but prevents either vertical or lateral slippage, sliding or travel. The shape of the apertures removes less metal and is less concentrated than heretofore considered possible, leaving a stronger rail. Furthermore, the shape and size of the apertures permits one or two strengthening spines to be formed in the rail between the attachment area and either or both longitudinal edges of the rail.

According to the invention, the seating depression is formed with a compound indentation which permits attachment of articulated links or direct attachment of the sinuous spring ends. As a result, the radial action of articulated links can be utilized at the front rail only, at the back rail only, or at both, to meet varying needs of spring pitch, height, cushioning and style requirements.

BRIEF DESCRIPTION OF THE DRAWINGS

The invention, including its construction and method of operation, together with additional objects and advantages thereof, is illustrated more or less diagrammatically in the drawings, in which:

FIG. 1 is a front elevational view of a rail (either front or back) in a steel frame illustrating the preferred form of rail attachment assembly embodying features of the invention;

FIG. 2 is a sectional view taken along line 2—2 of FIG. 1;

FIG. 3 is a sectional view taken along line 3—3 of FIG. 1;

FIG. 4 is a view similar to FIG. 1, showing the anchor link of the preferred form as it is about to be seated;

FIG. 5 is a sectional view taken along line 5—5 of FIG. 4;

FIG. 6 is a sectional view taken through a steel rail illustrating another form of the rail attachment assembly wherein a sinuous spring band end is attached directly to the rail; and FIG. 7 is a sectional view taken along line 7—7 of FIG. 6.

DESCRIPTION OF THE PREFERRED EMBODIMENTS

Referring now to the drawings, and particularly to FIGS. 1-3, a portion of a steel furniture frame unit is seen generally at 10. The frame unit portion 10 includes a steel rail 11, a sinuous spring band 12, and an anchor link 13 interconnecting them. The anchor link 13 is constructed in accord with the disclosure of U.S. Pat. No. 3,790,149, issued Feb. 5, 1974, and entitled SPRING CONSTRUCTION.

The rail 11 may be either a front rail or a back rail. In the illustration of FIGS. 1–3, it is a back rail. However, the same construction and rail-to-spring band connection can be made at the front rail, as will be hereinafter discussed.

The rail 11 is fabricated of a sheet steel channel or a steel bar. In the complete frame, of course, a plurality of spring bands 12 are connected to the rail 11. The connection is made at attachment assemblies, one of which is indicated generally at 15. In the form illustrated, the attachment assembly 15 includes the link 13, a pair of vertically elongated, irregularly shaped apertures 20 and 21, and the segment 22 of the bar between the apertures.

Irregularly shaped apertures 20 and 21 are die punched by conventional means in mirror images of each other. Each comprises a vertical portion 26 and a lower, outwardly extending lobe portion 27. The vertical aperture portions 25 are separated by the segment 22 of the bar between the apertures 20 and 21.

The segment 22 of the bar disposed between the lower lobe portions 27 of the apertures is deformed inwardly of the bar in the manner illustrated best in FIG. 3. This deformed portion of the segment 22, illustrated generally at 230, is made by suitable forming means in the cross-section illustrated. In effect, the deformation defines separate concave surfaces 31 and 32 having greater and lesser radii of curvature. In width, the greater radius is that of an 8 gauge wire, plus tolerance; and the lesser radius is that of a 13 gauge wire, plus tolerance. The depths of the deformation are equal to the diameters of said wire gauges, plus tolerance. Forming of the bar segment 22 outwardly adjacent the lowermost extremities of the vertical aperture portions 26 is facilitated by extending these vertical aperture portions slightly below the lower lobe portions 27, as illustrated at 28.

The anchor link 13 constructed in accord with the disclosure of U.S. Pat. No. 3,790,149 is formed of approximately 13 gauge wire. The link 13 has a base leg 40 and a pair of free legs 41 extending therefrom. The free legs 41 coverge toward each other from their attachment with the base leg 40 and terminate in attachment clips 42. The attachment clips 42 receive and hold the linear segment **12*a* on the free end of the sinuous spring band 12** in the manner illustrated.

In mounted relationship, the base leg 40 of the link 13 seats on the smaller radius surface 32 of the segment 22. The dimensions of the base leg 40 are such that its connection to the free legs 41 is made adjacent the outermost extremities of the lobe portions 27. In other words, the free legs 41 extend into these lobe portions 27 in the manner best illustrated in FIGS. 1 and 2.

With the base leg 40 of the link 13 seated on the surfaace 32, the link is free to pivot up and down as the spring band 12 is forced down by a load and, in turn, moves back up when the load is released. the pivot axis of rotation of the link 13 remains fixed. The base leg 40 cannot move upwardly or downwardly out of seated relationship because the innermost ends of the free legs 41, passing into the lobe portions 27 of the apertures, are confined by the vertical extremities of these lobe portions. At the same time, the link 13 cannot move to either side because these same legs 41 are stopped by the outermost extremities of the lobe portions 27. As a result, the link 13 is literally fixed on its rotational axis for pivoting movement only. No longitudinal or vertical movement which might cause grinding or squeeking noises, is permitted. A silent functioning spring attachment assembly 15 is the result.

The irregular shape of the apertures 20 and 21 not only serves to constrict undesirable movement of the link 13 in the manner hereinbefore described, it also facilitates mounting the link on the bar 11 and locking it in the attachment assembly 15. Referring to FIGS. 4 and 5, the link 13 is shown as it is passed through the apertures 20 and 21 toward its mounted relationship, illustrated in FIGS. 1–3.

The free end clips 42 of the legs 41 on the link 13 initially enter the vertical portions 26 of the apertures. As the link is moved further through the apertures 20 and 21 from the back of the rail 11, the diverging (in the direction of the base leg 40) legs 41 and clip 42 ends extend further and further into the lower lobe portions 27 and the upper lobe portions 26 respectively, of the apertures 20 and 21. The clip 42 ends soon pass through the lobe portions 26 while the legs 41 themselves continue to diverge in the lobe portions 27 until the link reaches its seated position, as best illustrated in FIG. 2. The link apertures 21 and 22; i.e., their shape, thus facilitate passage of the link through the channel or bar but also serve to lock the link in the channel or bar once it is seated.

Because of this unusual configuration of the apertures 20 and 21, they are relatively small in cross-sectional area; i.e., they actually require the removal of a minimal amount of metal. This serves to minimize weakening of the channel or bar which is created by punching apertures in the channel or bar. Accordingly, in a long sofa frame, for example, pairs of apertures 20 and 21 can be spaced relatively close together without noticeably weakening the channel or bar.

In addition, the minimal size of the apertures 20 and 21 facilitates the forming of stiffening spines 50 and 51 parallel to the upper and lower edges of the channel or bar. These stiffening spines further enhance the strength of the channel or bar and find particularly advantageous application in long sofa frames, for example. In the alternative, a single stiffening spine either above or below the apertures 20 and 21 might be employed.

Attention is now directed to FIGS. 6 and 7 where a modified form of the attachment assembly embodying features of the invention is illustrated generally at 215. Once again, a front rail 211 is fabricated from a steel bar. A plurality of conventional, sinuous spring bands 212, only one of which is shown, are connected to the rail 211 by the attachment assembly 215.

The attachment assembly 215 includes a pair of vertically elongated apertures 220 and 221 formed in the bar rail 211. The vertically elongated apertures 220 and 221 are horizontally spaced by a dimension determined by the dimensions of the end of the sinuous spring band 212; i.e., more precisely, the length of the endmost linear segment **212*a*** on the band.

In the attachment assembly 215 a portion of the segment 222 of the vertical steel bar rail 211 between the apertures 220 and 221 is deformed inwardly, as at 230, by suitable forming means so it has a cross-section such as illustrated in FIG. 6. Similar to the deformation 30 hereinbefore discussed, it is formed with separate concave surfaces 231 and 232, defining greater and lesser radii of curvature. The lesser radius of curvature surface 232 is designed to receive the base leg of an anchor link such as illustrated in FIG. 2, while the greater radius surface 231 is designed to receive the larger gauge linear segment 212*a* of the sinuous spring band 212 in the manner illustrated.

The sinuous spring band 212 thus pivots on a fixed axis about its seat on the surface 231. The end of the band 212 cannot ride up and down or sideways. Being confined in this manner it pivots silently without grinding or squeeking which might normally be associated with uncontrolled movement of the linear segment 212*a* in an attachment assembly.

While several embodiments described herein are at present considered to be preferred, it is understood that various modifications and improvements may be made therein, and it is intended to cover in the appended claims all such modificiations and improvements as fall within the true spirit and scope of the invention.

What is desired to be claimed and secured by Letters Patent of the United States is:

1. A rail attachment assembly for attaching an end of a sinuous spring band to a vertical flange of a steel frame rail, comprising:

a. a pair of apertures formed through said flange in spaced relationship longitudinally of said flange, b. a portion of the segment of said flange between said apertures being deformed inwardly of said flange, c. said deformed portion defining at least two co-extensive concave surfaces extending longitudinally of said flange between said apertures, d. said two co-extensive concave surfaces comprising a first surface having a greater radius of curvature and a second surface having a lesser radius of curvature, e. said second surface being formed horizontally inwardly of said vertical flange from said first surface, and f. a wire-like element on the end of said band seated on one of said concave surfaces to attach said band to said rail with said band extending generally horizontally away from said vertical flange.

2. A rail for a furniture frame comprising:

a. a longitudinally extending steel bar having a vertical flange, b. a pair of apertures formed through said flange in spaced relationship longitudinally of said flange, c. a portion of the segment of said flange between said apertures being deformed inwardly of said flange, d. said deformed portion defining at least two co-extensive concave surfaces extending longitudinally of said flange between said apertures, e. said two co-extensive concave surfaces comprising a first surface having a greater radius of curvature and a second surface having a lesser radius of curvature, and f. said second surface being formed horizontally inwardly of said vertical flange from said first surface.

3. A rail attachment assembly for attaching an end of a sinuous spring band to a vertical flange of a steel frame rail, comprising:

a. a pair of apertures formed through said flange in spaced relationship longitudinally of said flange, b. a portion of the segment of said flange between said apertures being deformed inwardly of said flange, c. said deformed portion defining at least one concave surface extending longitudinally of said flange between said apertures, and d. a generally U-shaped link member having a base leg seated on said concave surface and converging legs extending from said base leg through said apertures generally perpendicular to said flange, with clips on the free ends of said converging legs connecting the link member to the end of the spring band, and e. said apertures being formed so as to permit the passage of said link converging legs therethrough from the back of said rail to seat said base leg on said concave surface while preventing vertical or longitudinal movement of said link base leg on the rail once it is seated, f. each of said apertures each including a vertical aperture portion and a longitudinally outward extending lobe aperture portion, g. each of said link converging legs disposed in said lobe aperture portions when said link base leg is seated on said concave surface.

4. The rail attachment assembly of claim 3 further characterized in that;

a. each of said apertures further including a second longitudinally outward extending lobe aperture portion, b. said second lobe aperture portion serving to permit said link clips to pass through corresponding apertures when said link is seated.

* * * * *